United States Patent [19]

Patton

[11] Patent Number: 5,019,869

[45] Date of Patent: May 28, 1991

[54] TONER FUSING/FINISHING DEVICE FOR SELECTING ALTERNATIVELY THE STYLE OF FINISHING ON A GLOSSY, MATTE, OR TEXTURED PRINT FINISH

[75] Inventor: David L. Patton, Webster, N.Y.

[73] Assignee: Eastman Kodak Company, Rochester, N.Y.

[21] Appl. No.: 326,824

[22] Filed: Mar. 21, 1989

[51] Int. Cl.[5] ..... G03G 15/20

[52] U.S. Cl. ..... 355/290; 219/216; 219/469; 355/285; 355/295

[58] Field of Search ..... 355/282, 285, 289, 290, 355/295; 354/351, 352, 353; 430/97, 99, 104, 124; 428/651, 652, 653; 219/216, 469, 470, 471

[56] References Cited

U.S. PATENT DOCUMENTS 4,179,541 12/1979 Miyama et al. ..... 428/165
4,290,691 9/1981 Giorgini .
4,369,405 1/1983 Sato et al. ..... 324/174
4,549,803 10/1985 Ohno et al. .
4,928,148 5/1990 Higashi ..... 355/290

*Primary Examiner*—A. T. Grimley
*Assistant Examiner*—J. E. Barlow, Jr.
*Attorney, Agent, or Firm*—Raymond L. Owens

[57] ABSTRACT

A selected finish is applied to a electrophotographic print of a photographic negative at a fusing station. One of a plurality of finishing rollers is moved into operative engagement with a fusing roller to provide the desired finish. The fusing roller is heated internally. The finishing rollers which are rotatable brought into contact with the fusing roller each have a different and distinct surface characteristic. Three types are surfaces are described these being a glossy surface, a matte surface and a textured surface.

2 Claims, 2 Drawing Sheets

TONER FUSING/FINISHING DEVICE FOR SELECTING ALTERNATIVELY THE STYLE OF FINISHING ON A GLOSSY, MATTE, OR TEXTURED PRINT FINISH

FIELD OF THE INVENTION

This invention relates to method and apparatus for making prints from photographic negatives by fixing toner images to a support by means of heat and pressure.

BACKGROUND ART

In an electrostatographic process, an image formed by fusible toner particles is transferred to a support such as a copy sheet. This toner image is permanently fixed to the support by passing the support through a fuser.

Fused toner images normally exhibit a dull surface. In certain types of images, particularly colored toner images, it is desirable for the image to have a surface gloss. One example of apparatus for providing colored images with a surface gloss is shown in U.S. Pat. No. 4,639,405. In this patent, there is disclosed fusing apparatus for fixing toner images to copy substrates comprising a first pair of rolls, one of which is provided with a conformable outer surface, and a second pair of rolls, one of which has a rigid outer surface. Copy sheets are passed sequentially through the first and second pairs of rolls, the first pair serving as a fuser means and the second pair as a glossing means.

In a photofinishing operation it is desirable to produce prints of negatives which have different surface finishes such as glossy, matte, and textured. In one arrangement, a roll of paper has a desired surface finish already on the surface of the paper used in a photofinisher. When a different surface is desired, the operator must shutdown the device producing the prints and change the paper sheets or roll to the one having the desired surface.

SUMMARY OF THE INVENTION

It is the object of the present invention to overcome the above-described problem in the prior art and to provide a method and apparatus for making toner images of a negative and for fixing such toner images to produce a high-quality print with a desired surface finish.

In accordance with the present invention, there is disclosed a method of finishing a print of a photographic negative having a surface layer which can have a desired finish imparted to it, such print being produced by an electrophotographic copier in which the print is passed through a fusing station having a rotatable fusing roller, comprising the steps of electrophotographically forming a toner image of a photographic negative on a print, selecting a finishing roller from a plurality of rollers each of which can provide a different finish to the print surface, and moving such selected roller into operative relation with the rotatable fusing roller to provide a desired finish to the print which passes through the nip formed by such cooperating rollers.

In accordance with a disclosed embodiment of the invention, there is three rollers which respectively provide, glossy, matte and textured finishes.

In a electrophotographic copier which produces a print of a photographic negative having a desired finish, finishing apparatus comprises a fusing roller, a plurality of finishing rollers, each of such finishing rollers having a surface selected to impart a different finish to a print, means for moving a selected one of such finishing rollers into operative engagement with the fusing roller to provide a nip, and means for providing heat to the nip so that when a print passes through the nip the desired finish is imparted to the print surface.

An important feature of the present invention is that the fusing and finishing by the same two rollers without any deleterious effects such as paper curl or blister in. The disclosed method and apparatus can be used to fix toner images on copy sheets in a complex mode (image in one side of the sheet) and in a duplex mode (image on both sides of the sheet).

Other features and advantages will become apparent upon reference to the following description of the preferred embodiment when read in light of the attached drawings.

DESCRIPTION OF THE PREFERRED EMBODIMENT

The present invention is adapted to be used in electrophotographic apparatus such as that shown and described in commonly-assigned U.S. Pat. No. 4,025,186 issued May 24, 1977. As disclosed therein, a photoconductive member is moved past a series of work stations. At the start of the copy cycle, the photoconductive member receives an electrostatic charge at a charging station. A light image of a negative is then projected onto the charged photoconductive member at an exposure station to form a latent electrostatic image. The electrostatic image is developed with toner and a receiver brought into contact with the photoconductive member at a transfer station after the toner image is transferred to the receiver, it will be referred to as the print. The print carrying the unfused toner image is separated from the conductive member and passed through a fusing station comprised of a plurality of two rollers to permanently fuse the toner image to the print.

The term "gloss, matte, textured" in the present application refers to the external finish of the print surface.

Figure 1:
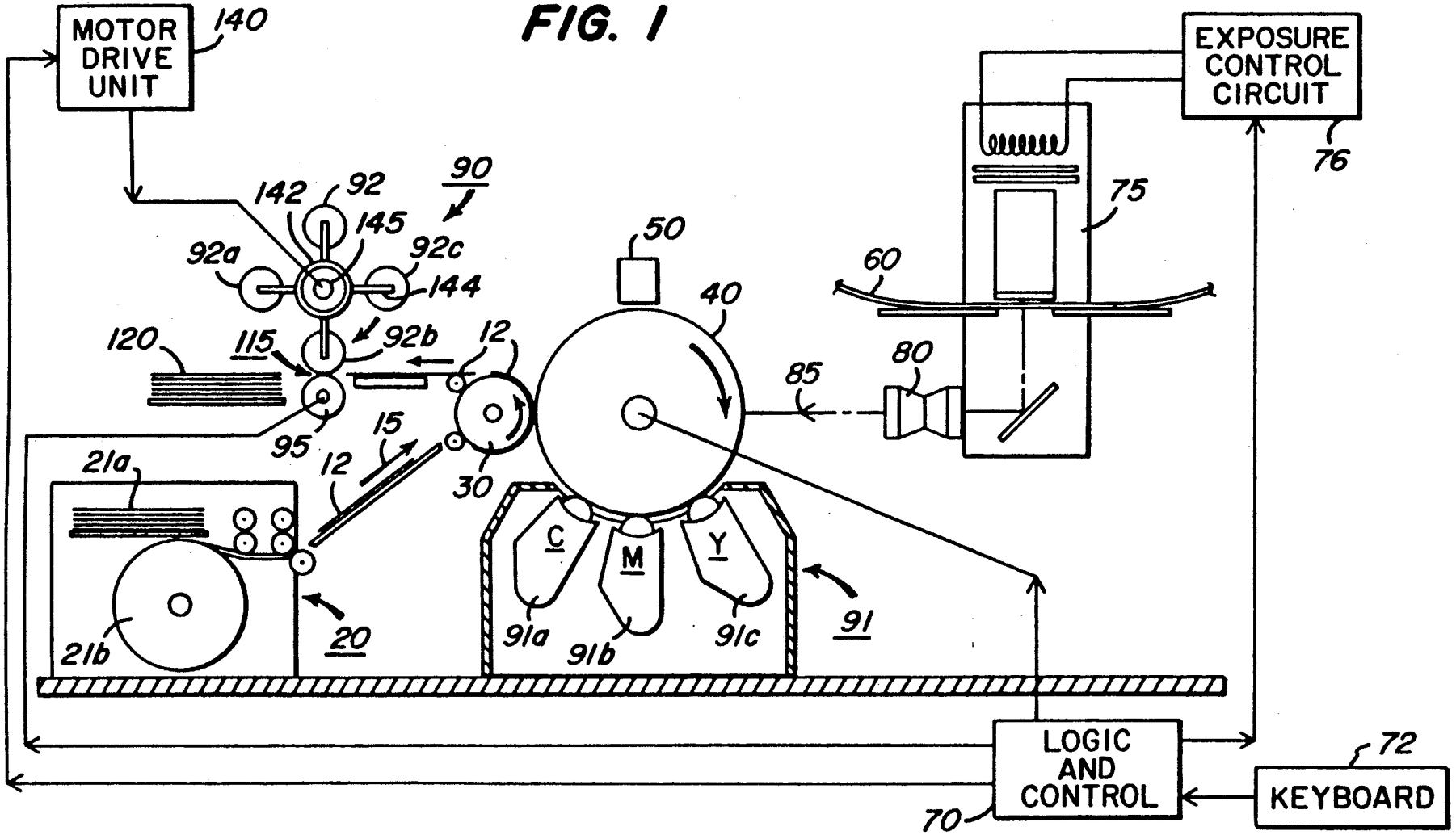
FIG. 1 is a schematic in accordance with the invention of an electrophotographic apparatus for producing prints of photographic negatives.

With reference to FIG. 1 there is shown an apparatus for feeding a receiver 12 in direction 15 from a paper supply 20 in sheet form 21*a* or continuous web form from a paper roll 21*b* onto a transfer station 30, where the receiver 12 is brought into intimate contact with a photoconductive member 40 controlled by a logic and control unit 70. An operator provides an input via a keyboard 72 to the logic and control unit 70. The photoconductive member 40 shown as a rotatable drum receives an electrostatic charge from the charging station 50. Cyan, magenta, and yellow images of a photographic negative 60 are sequentially exposed by a flash lamp in a housing 75. The flash lamp is actuated by exposure central circuit 76 which is controlled by logic and control unit 70.

The light image of the negative passes through a lens 80 and is directed in direction 85 onto the photoconductive member 40. As the photoconductive member 40 rotates light images sequentially create cyan, magenta and yellow electrostastic latent image on the surface of the photoconductive member 40. The cyan, magenta and yellow electrostatic latent images are sequentially developed with toner from toner station 91 comprised of cyan toner station 91*a*, magenta toner station 91*b* and yellow toner station 91*c*. The developed colored toner images are then sequentially transferred to a receiver 12 brought into contact with the photoconductive member 40 at the transfer station 30. The receiver 12 carrying the three unfused toner images are separated from the conductive member and passed through a fusing station 90.

The fusing station 90 includes a plurality of individual selectable upper rollers, each with its own surface finish: roller 92 (without finish), glossy roller 92*a*, matte roller 92*b* and textured roller 92*c*. These rollers are capable of imparting the desired finish to the receiver surface 12 while the receiver 12 passes between the selected upper rollers 92 and the lower fusing roller 95, a motor drive unit 140 and the logic and control unit 70 are capable of moving the selected upper roller into a cooperative position with a roller 95 to form a nip 115.

As the receiver 12 passes through the nip 115 formed by cooperating roller 92 and 95, the surface of the top fusing roller is imparted onto the receiver surface 12 providing respectively the glossy, matte and textured print surfaces. From the fusing station 90, the receivers 12 which will be now referred to as prints, are delivered to a receiver tray 120 and stacked in order. Reference can be made to commonly assigned U.S. Pat. No. 4,639,405 which describes in detail the construction of fusing rollers.

The lower fusing roller 95 is continuously rotated by a motor (not shown) and provides the force for translating a receiver 12 in the nip 115 and for rotating the upper roller which has been disposed at the nip by a motor drive unit 140.

In operation, an operator using the keyboard 72 selects a desired finish for a print. The logic and control unit 70 controls the motor drive unit 140 which rotates the assembly 142 which positions the selected fusing roller in operative engagement with the drive roller 95. As the lower roller 95 is rotated, a receiver is driven through the nip 115 and the toner image is fused and has a desired finish imparted to the print surface.

Figure 2:
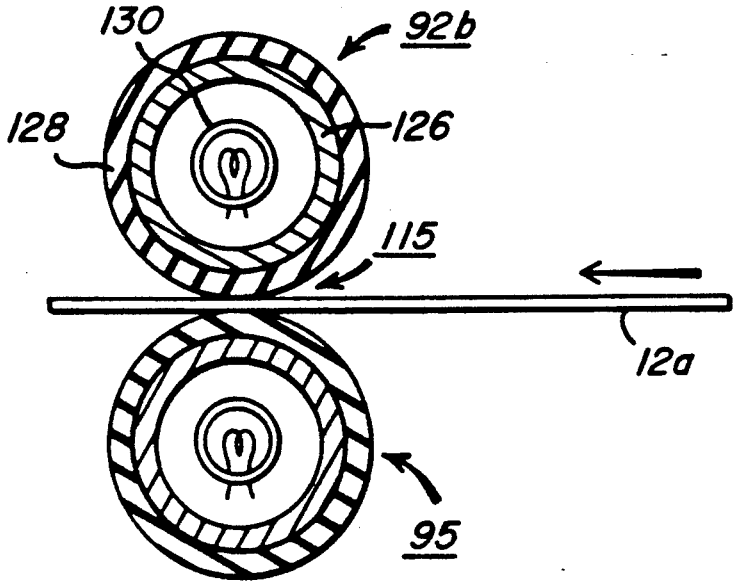
FIG. 2 is a cross section of two rollers in the fusing station of FIG. 1.

Turning briefly to FIG. 2, there is shown a receiver 12*a* in the nip 115 between bottom roller 95 and a selected top roller 92*b*. Roller 92*b* has a matte surface finish. Roller 92*b* and lower roller 95 are identical in the preferred embodiment except for their surface finish and thus, only roller 92*b* will be described. Roller 92*b* comprises an inner cylinder 126 which is made from a conductive metal, and an elastomeric coating 128 formed on the cylinder 126. Although not shown, the coating 128 has its surface textured to impart a matte finish to a print. A infrared lamp 130, located generally at the center of roller 92*b* provides heat for such roller. Roller 92*b* can be, for example, approximately three inches in diameter and lamp 130 can be a 1,250 watt lamp. Rollers 92*b* and 95 are biased toward each other as is well known. In this example, both the upper and lower rollers have integral heat sources. However, it will be understood that only the bottom roller 95 could be provided with a heat source.

Returning now to FIG. 1, the motor drive unit 140 selectively moves one of the upper rollers into operative engagement with the lower fusing roller 95. The motor drive unit 140 includes a drive stepper motor is controlled by the logic and control unit 70. The stepper motor is connected to a rotatably mounted assembly 142. The stepper motor rotates assembly 142 in a clockwise direction until a selected roller is disposed in cooperative relation with roller 95. The assembly 142 includes a plurality of bifurcated arms 144, bearings and necessary mounting bracketry (not shown). The bifurcated arms (only one of which is shown) rotatably mount the upper rollers so that the selected roller can rotate as receiver 12 passes through the roller nip 115.

The invention has been described in detail with particular reference to a preferred embodiment thereof, but it will be understood that variations and modifications can be effected within the spirit and scope of the invention.

What is claimed is:

1. In an electrophotographic copier which produces a print of a photographic negative having a desired finish, finishing apparatus comprises:

(a) a fusing roller;

(b) a plurality of finishing rollers, each of such finishing rollers having a surface selected to imparted a different finish to a print;

(c) means for moving a selected one of such finishing rollers into operative engagement with the fusing roller to provide a nip; and (d) means for providing heat to the nip so that when a print passes through the nip the desired finish is imparted to the print surface.

2. The apparatus of claim 1, wherein there are three finishing rollers which respectively impart glossy, matte, and textured finishes to the surface of the print.

* * * * *